US011619000B2

(12) United States Patent
Hämäläinen et al.

(10) Patent No.: US 11,619,000 B2
(45) **Date of Patent: *Apr. 4, 2023**

(54) METHOD AND A SYSTEM FOR ADJUSTING S/NA-BALANCE OF A PULP MILL

(71) Applicant: Valmet Technologies Oy, Espoo (FI)

(72) Inventors: Risto Hämäläinen, Tampere (FI); Seppo Tuominiemi, Pirkkala (FI)

(73) Assignee: VALMET TECHNOLOGIES OY, Espoo (FI)

( * ) Notice: Subject to any disclaimer, the term of this patent is extended or adjusted under 35 U.S.C. 154(b) by 251 days.

This patent is subject to a terminal disclaimer.

(21) Appl. No.: 16/769,475

(22) PCT Filed: Dec. 20, 2018

(86) PCT No.: PCT/FI2018/050946

§ 371 (c)(1),
(2) Date: Jun. 3, 2020

(87) PCT Pub. No.: WO2019/129921

PCT Pub. Date: Jul. 4, 2019

(65) Prior Publication Data

US 2020/0385925 A1 Dec. 10, 2020

(30) Foreign Application Priority Data

Dec. 29, 2017 (FI) ..... 20176188
Dec. 29, 2017 (FI) ..... 20176189

(51) Int. Cl.
*D21C 11/08* (2006.01)
*D21C 11/00* (2006.01)
*D21C 11/06* (2006.01)

(52) U.S. Cl.
CPC ..... *D21C 11/08* (2013.01); *D21C 11/0007* (2013.01); *D21C 11/0014* (2013.01); *D21C 11/0057* (2013.01); *D21C 11/06* (2013.01)

(58) Field of Classification Search
CPC ..... D21C 11/0007; D21C 11/06; D21C 11/08; D21C 11/0057
See application file for complete search history.

(56) References Cited

U.S. PATENT DOCUMENTS 3,331,732 A 7/1967 Venemark
4,137,134 A * 1/1979 Suominen ..... B01D 3/38 203/92

(Continued)

FOREIGN PATENT DOCUMENTS

CN 1079449 A 12/1993
CN 1125432 A 6/1996

(Continued)

OTHER PUBLICATIONS

Syed et al., Removal of hydrogen sulfide from gas stream using biological processes—A review, 2006, Canadian Biosyste2006ms Engineering, vol. 48, p. 2.1-2.14 (Year: 2006).*

(Continued)

*Primary Examiner* — Anthony Calandra
(74) *Attorney, Agent, or Firm* — Alston & Bird LLP

(57) ABSTRACT

The invention relates to a method and a system for adjusting S/Na-balance of a pulp mill, wherein an aqueous pulp mill liquor containing sulphides is diverted into a bioreactor and oxidized by means of sulphur-oxidizing microbes, thereby producing an aqueous suspension from which elemental sulphur can be separated as a precipitate and the residual solution may be directed to causticizing. Optionally, prior to oxidation in the bioreactor, the aqueous pulp mill liquor may be first stripped to obtain a gas stream containing H2S which is then scrubbed with a scrubbing solution to obtain an aqueous spent scrubbing solution containing sulphides, in which case the residual solution can be used to replenish the scrubbing solution.

24 Claims, 3 Drawing Sheets

(56) References Cited

U.S. PATENT DOCUMENTS

| | | | | |
|---|---|---|---|---|
| 4,225,381 | A * | 9/1980 | Ishikawa | C12N 1/145 422/4 |
| 5,196,069 | A | 3/1993 | Cullingford et al. | |
| 5,702,570 | A * | 12/1997 | Smith | D21C 11/00 162/30.11 |
| 5,976,868 | A | 11/1999 | Buisman | |
| 6,440,379 | B1 * | 8/2002 | Verrill | B01D 53/1412 422/171 |
| 2020/0291574 | A1 | 9/2020 | Hämäläinen | |

FOREIGN PATENT DOCUMENTS

| | | | |
|---|---|---|---|
| CN | 1218421 | A | 6/1999 |
| CN | 1226225 | A | 8/1999 |
| CN | 1228118 | A | 9/1999 |
| CN | 1798600 | A | 7/2006 |
| CN | 102413900 | A | 4/2012 |
| CN | 105498470 | A | 4/2016 |
| EP | 095 8251 | B1 | 10/2002 |
| WO | WO-1992/010270 | A1 | 6/1992 |
| WO | WO-1994/029227 | A1 | 12/1994 |
| WO | WO-1996/030110 | A1 | 10/1996 |
| WO | WO-1997/043033 | A1 | 11/1997 |
| WO | WO-1998/002524 | A1 | 1/1998 |
| WO | WO-1998/004503 | A1 | 2/1998 |
| WO | WO-1999/057365 | A1 | 11/1999 |
| WO | WO-2000/020679 | A1 | 4/2000 |
| WO | WO-2010/115871 | A1 | 10/2010 |

OTHER PUBLICATIONS

Benschop, A., A. Janssen, A. Hoksberg, M. Seriwala, R. Abry and C. Ngai. 2002. The shell-Paques/THIOPAQ gas desulphurization process: Successful start up first commercial unit. http://www.paques.nl (Feb. 15, 2006) (Year: 2002).*

Office Action for Finnish Patent Application No. 20176188, dated Jul. 6, 2018, (6 pages), Finnish Patent and Registration Office, Helsinki, Finland.

Office Action for Finnish Patent Application No. 20176189, dated Jul. 26, 2018, (8 pages), Finnish Patent and Registration Office, Helsinki, Finland.

International Searching Authority, International Search Report and Written Opinion for International Application No. PCT/FI2018/050947, dated Apr. 5, 2019, (12 pages), European Patent Office, Rijswijk, Netherlands.

International Searching Authority, International Search Report and Written Opinion for International Application No. PCT/FI2018/050946, dated May 7, 2019, (16 pages), European Patent Office, Rijswijk, Netherlands.

Screen captures from YouTube video clip entitled "The THIOPAQ Process," Paques TV, 4 pages, [online], Jul. 28, 2015. [Retrieved from the Internet Jun. 18, 2018] <https://www.youtube.com/watch?v=c-x7vSZwSOs>.

* cited by examiner

METHOD AND A SYSTEM FOR ADJUSTING S/NA-BALANCE OF A PULP MILL

CROSS REFERENCE TO RELATED APPLICATIONS

This application is a National Stage Application, filed under 35 U.S.C. 371, of International Application No. PCT/FI2018/050946, filed Dec. 20, 2018, which international application claims priority to and the benefit of both: Finnish Application No. 20176188, filed Dec. 29, 2017; and Finnish Application No. 20176189, filed Dec. 29, 2017; the contents of all of which as are hereby incorporated by reference in their entireties.

BACKGROUND

Related Field

The invention relates to a method and a system for adjusting S/Na-balance of a pulp mill. Some aspects of the invention relate to a method and a system for separating sulphur from pulp mill liquor. Some aspects of the invention relate to a method and a system for biological oxidation of sulphur compounds of pulp mill liquor inside a pulp mill.

Description of Related Art

Industrial pulping processes, chemical pulping processes in particular, are utilized to remove hemicelluloses and lignin from the wood-based raw material in order to provide cellulose fibres. The chemical cooking process, sulphate cooking in particular, uses a combination of high temperature and pulping chemicals to break the chemical bonds of lignin, which is a natural biopolymer in the wood that binds the cellulose fibres together. In a sulphate cooking process, wood-based material is mixed in a digester with an aqueous solution of pulping chemicals, and then heated with steam. An example of a sulphate process is the Kraft process, wherein the main pulping chemicals are sodium hydroxide (NaOH) and sodium sulphide ($Na_2S$). The chemical cooking process separates cellulose fibres from the lignin and hemicellulose components, and produces spent cooking liquor, referred to as black liquor. This liquor containing the spent cooking chemicals and by-products is then concentrated and typically burned to recirculate the cooking chemicals. Recirculation of the cooking chemicals is typically referred to as the liquor cycle or the chemical recovery cycle of a pulp mill.

Due to tightened legislation relating to environmental protection, modern pulp mills need to circulate chemicals more carefully as well as try to diminish the accumulation of sulphur compounds in the environment. Conventional means for dealing with sulphur containing side streams formed at the pulp mill processes have been to dump the side streams as a fly ash or to recirculate the sulphur containing side streams to other processes for manufacture of industrial chemicals. One example for sulphur recovery is the combustion of malodorous gases, which are formed as a by-product of the pulp manufacturing process. The combustion of the malodorous gases produces flue gas containing sulphur oxides, which may be recovered and further used to manufacture for example sulphuric acid. Sodium bisulphite, dithionite and gypsum are other examples of possible products which may be manufactured from the sulphur containing side streams of a pulp mill. However, the refining of pulp mill flue gas or sulphur containing side streams to more valuable chemicals requires massive capital investments and separate chemical plants. The refining may further be problematic from the environmental perspective. Furthermore, such investments are time consuming and may be difficult to retrofit to already existing processes at conventional pulp mills.

Sulphur is a critical chemical in the chemical cooking process of a sulphate pulp mill and needs to be removed from and replenished to the chemical recovery cycle on a continuous basis. A particular downside related to the conventional ways for recovering sulphur from the pulp mill is the concomitant loss of sodium from the chemical cooking process, which is typically recovered together with the sulphur. This leads to loss of two critical elements in the cooking chemicals, which is undesirable for the S/Na-balance of the pulp mill. It is therefore a constant dilemma how the total sulphur content of the chemical recovery cycle could be reduced and how the S/Na-balance of the pulp mill could be improved in view of stricter legislation. The accumulation of sulphur into the chemical recovery cycle is a continuous challenge for the efficient operation of the pulp mill. Thus, there is a need for a cost-effective and environmentally friendly method and system for controlling the S/Na-balance of a pulp mill that are easier to implement on an already existing process of a conventional pulp mill.

BRIEF SUMMARY

The above disclosed problems may be addressed by providing a method and a system which enables adjustment of S/Na-balance of a pulp mill by separation of sulphur compounds from pulp mill liquors, such as green or white liquors, which comprise sulphides, and oxidation of sulphides into elemental sulphur with microbes. An advantage is that the total sulphur content of the pulp mill processes may be reduced, since the circulation of sulphur in the pulp mill processes is shorter, when the excessive sulphur is recovered from the liquor cycle, instead of later phases of the process, such as the gases or fly ash formed in the pulp mill processes. A further advantage is, that adjusting the S/Na-balance of the pulp mill may be implemented in a simpler and faster manner. Moreover, sulphur may be recovered in its elemental form without losing sodium at the same time. This reduces the need for adding make-up NaOH in order to adjust the sulphidity of the pulp mill, thereby lowering the costs and enabling avoidance of unnecessary use of chemicals. Thus, adjusting S/Na-balance of the pulp mill in a cost-efficient and environmentally friendly manner is enabled.

Recycling of the spent cooking chemicals in a pulp mill is denoted as a liquor cycle or chemical recovery cycle of the pulp mill. The used cooking chemicals may be burnt in a recovery boiler thus forming a molten 'smelt' that may be dissolved into a liquid. Thus formed liquid may be denoted as green liquor due to a characteristic green color. Green liquor may be used to prepare white liquor for the pulping process. The liquor cycle is designed to recover the chemicals used in the pulping.

Sulphur balance control is important in a pulp mill. As sulphur is introduced to the cooking process, typically as sodium sulphide ($Na_2S$), sulphur also has to be removed from the chemical recovery cycle in some form in order to avoid excessive sulphur content in the cycle. Excessive sulphur content as well as unnecessary low sulphur content in the chemical recovery cycle may cause operational problems resulting for example in poor pulping liquor quality, increased mill energy consumption, and decreased mill production capacity. S/Na-balance of a pulp mill is related to sulphidity. Sulphidity is a percentage value of a ratio between amounts of $Na_2S$ and active alkali in the pulp mill white liquor. Active alkali refers to NaOH and $Na_2S$. The optimum sulphidity depends on several factors, such as wood species, alkali charge, cooking temperature and properties desired in the final product. Typically the sulphidity may vary between 20-50%.

Green liquor containing $Na_2S$ and NaHS is an essential part of the liquor cycle taking care of the recovery of chemicals used in the pulping. White liquor, which is formed of green liquor also contains sulphides as disclosed above.

Thus, a green liquor stream diverted from a recovery boiler or a green or white liquor stream diverted later from the process represent convenient sources of material for adjustment of S/Na-balance of a pulp mill by removing sulphur from the chemical recovery cycle.

According to an aspect of the invention, at least part of a pulp mill liquor stream, such as green or white liquor stream, containing sulphides is diverted into a bioreactor. The liquor containing sulphides may then be oxidized biologically in the bioreactor by means of sulphur-oxidizing microbes, thus forming elemental sulphur. The elemental sulphur may then be recovered.

According to another aspect of the invention, at least part of a pulp mill liquor stream, such as green or white liquor stream, containing sulphides may be diverted into a stripper. The pulp mill liquor containing sulphides may be stripped in the stripper with an acidic agent. The acidic agent lowers the pH of the pulp mill liquor. By this way, sulphides of the pulp mill liquor may be transformed into gaseous $H_2S$. Thus, a gas stream containing $H_2S$ and a residual pulp mill liquor stream may be obtained. The gas stream containing $H_2S$ is then scrubbed in a scrubber with an aqueous scrubbing solution containing an alkaline agent, such as NaOH. When contacted, $H_2S$ reacts with the alkaline agent, thereby producing an aqueous spent scrubbing solution containing sulphides, such as $Na_2S$ and NaHS, which sulphides, when reacted, transfer themselves from the gaseous phase into the liquid phase, such that a selective sulphide conversion may be obtained. The aqueous spent scrubbing solution containing sulphides is then oxidized biologically in a bioreactor by means of sulphur-oxidizing microbes, thereby forming elemental sulphur. The elemental sulphur may then be recovered.

Therefore, there is provided a method for adjusting S/Na-balance of a pulp mill, which method comprises diverting an aqueous pulp mill liquor containing sulphides into a bioreactor, oxidizing the aqueous pulp mill liquor containing sulphides in the bioreactor biologically in an oxidizing reaction by means of sulphur-oxidizing microbes, thereby producing an aqueous suspension containing elemental sulphur, and separating the elemental sulphur from the aqueous suspension in a sulphur separation unit located downstream of the bioreactor, thereby obtaining a residual solution and a precipitate containing the elemental sulphur.

Optionally, a method for adjusting S/Na-balance of a pulp mill may comprise diverting an aqueous pulp mill liquor containing sulphides into a stripper, stripping the aqueous pulp mill liquor containing sulphides in the stripper with an acidic agent, thereby obtaining a gas stream containing $H_2S$ and a residual pulp mill liquor stream, scrubbing the gas stream containing $H_2S$ in a scrubber located downstream of the stripper with an aqueous scrubbing solution containing an alkaline agent, whereby at least some of the $H_2S$ reacts with the alkaline agent, thereby producing a residual gas stream and an aqueous spent scrubbing solution containing sulphides, conducting the aqueous spent scrubbing solution into a bioreactor, oxidizing the aqueous spent scrubbing solution containing sulphides in the bioreactor biologically in an oxidizing reaction by means of sulphur-oxidizing microbes, thereby producing an aqueous suspension containing elemental sulphur, and separating the elemental sulphur from the aqueous suspension in a sulphur separation unit located downstream of the bioreactor, thereby obtaining a residual solution and a precipitate containing the elemental sulphur.

Objects according to the invention are further described in the appended claims.

Figure 1:
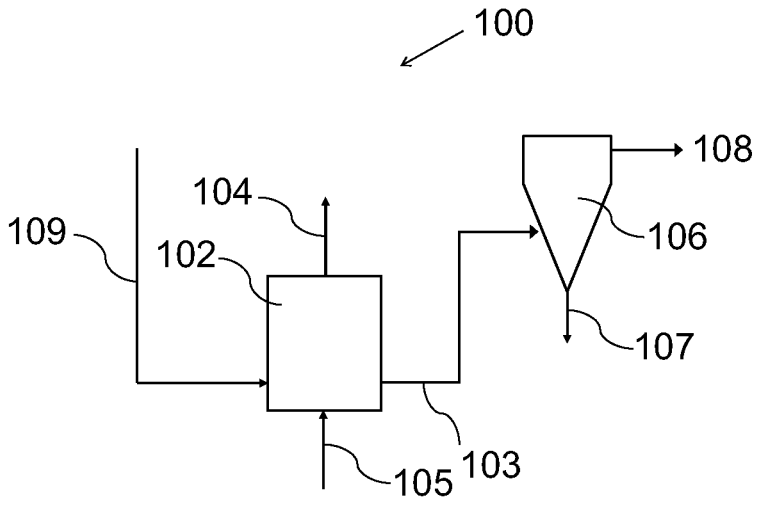
FIG. 1 illustrates, by way of an example, a process diagram of a system configured to adjust S/Na-balance of a pulp mill.

The figures are schematic. The figures are not in any particular scale.

DETAILED DESCRIPTION

The term "scrubber" refers to an air pollution control device which is used to remove particulates or compounds from a pulp mill exhaust gas stream. An aqueous solution may be introduced into the scrubber to collect unwanted pollutants from a gas stream into an aqueous spent scrubbing solution.

The term "efficiency" refers to a quantitative ratio of output to the total input. Unless otherwise stated, efficiency in this context is calculated as a percentage of the theoretical maximum, which the given total input quantities could yield. In other words, efficiency is expressed as a percentage of the result that could ideally be expected.

The term "weak malodorous gas" typically refers to a gas having a sulphur concentration of less than 0.5 $g/m^3$. Weak malodorous gas may also be called a diluted malodorous gas. The weak malodorous gases may in a pulp mill environment originate for example from chip-pre-steaming, screening, pulp washing, smelt dissolver and ventilation of various tanks.

The term "strong malodorous gas" typically refers to a gas having a sulphur concentration above 5 g/m$^3$. The strong malodorous gases may in a pulp mill environment originate for example from digester, evaporation plant and condensate stripper.

The term "volumetric flow rate" refers to a volume of a fluid passing per unit of time.

The term "mass flow rate" refers to a mass of a substance passing per unit of time.

Within the context of this specification, the term "sulphides" refers to compounds or substances comprising $HS^-$ or $S^{2-}$ entities. Those compounds or substances include, for example, NaHS and $Na_2S$, as well as their hydrates.

The term "clarifying" refers to a process in which a fluid, usually a liquid, is made clear by removing impurities or solid matter.

The term "aerating" refers to supplying oxygen or air. Aeration is a process by which air is circulated through, mixed with or dissolved in a liquid, thereby allowing oxygen to be transferred into the liquid, such as an aqueous solution.

In a chemical pulp production cooking is used for recovering fibres from chips in a digester by using chemicals and heat in order to remove fibre binding lignin and, in addition, to remove wood extractives which may later cause foaming and precipitants in the process. Therefore, chemicals which dissolve as much lignin and as little cellulose as possible are typically used in the pulping process. Typically, the process for manufacturing bleached chemical pulp comprises pulping, washing, screening, bleaching, and cleaning stages. Nowadays sulphate cooking, also called as Kraft cooking or pulping, which uses a mixture of sodium hydroxide (NaOH) and sodium sulphide ($Na_2S$), is the most commonly used pulp production method. The cooking process may be based on batch cooking or continuous cooking comprising a digester or several digesters. The chemicals required for this process are used in a mixture denoted as white liquor.

In pulping, sodium sulphide ($Na_2S$) and sodium hydroxide (NaOH) of white liquor react with water forming hydrosulphide ($HS^-$) and hydroxyl ($OH^-$) groups according to equations 1 and 2.

$$Na_2S+H_2O \rightarrow 2Na^++HS^-+OH^- \quad \text{(Equation 1)}$$

$$NaOH \rightarrow Na^++OH^- \quad \text{(Equation 2)}$$

As a result of the pulping process, black liquor is formed. The pulp coming from the digester contains both fibres and spent cooking liquor (black liquor). A large amount of chemicals is used in a chemical pulp production, and recovery and re-use of these chemicals is required. The main process units in the chemical recovery system of a pulp mill are the evaporation of the black liquor, burning of the evaporated liquors in a recovery boiler and causticizing, including lime generation.

The recovery boiler is used to recover the cooking chemicals. When burnt, the cooking chemicals form a molten 'smelt' at the bottom of the recovery boiler. The smelt may be dissolved into a liquid. Thus formed liquid may be denoted as green liquor due to a characteristic green color. Green liquor may be used to prepare white liquor for the pulping process. The recycling of these spent cooking chemicals is denoted as a liquor cycle. The liquor cycle is designed to recover the chemicals used in the pulping. In particular, the recovery boiler aims to recover sodium carbonate ($Na_2CO_3$) and sodium sulphide ($Na_2S$). The green liquor is clarified and causticized with lime, in which process $Na_2CO_3$ is converted to NaOH. Besides NaOH and $Na_2S$, white liquor also comprises other sodium salts, such as sodium sulphate ($Na_2SO_4$), and small amounts of sulphites and chlorides.

Sulphur balance control is important in a pulp mill. As sulphur is introduced to the cooking process, sulphur also has to be removed from chemical recovery cycle in order to avoid excessive sulphur content in the cycle. S/Na-balance of a pulp mill is related to sulphidity. Sulphidity is a percentage value of a ratio between amounts of $Na_2S$ and active alkali in the pulp mill white liquor. Active alkali refers to NaOH and $Na_2S$. Sulphidity may typically vary between 20-50%. Equation 3 may be used to express sulphidity. The amounts of $Na_2S$ and NaOH may be expressed in grams of NaOH equivalents, or in percentages of dry wood. Sulphidity of a pulp mill may be determined using standards NaOH SCAN-N 30:85 and $Na_2S$ SCAN-N 31:94. Sulphidity of the pulp mill may be maintained at a desired level by adding make-up NaOH to the chemical recovery cycle. This, however, causes extra costs and requires unnecessary use of chemicals.

$$\frac{Na_2S}{NaOH+Na_2S}\cdot 100 \quad \text{(Equation 3)}$$

The current specification discloses a method and a system for adjusting S/Na-balance of a pulp mill by removing sulphur compounds from the chemical recovery cycle in a pulp mill, as well as for processing of the sulphur compounds into elemental sulphur, which is of high intrinsic value. Chemically, sulphur reacts with almost all elements except for some noble metals and the noble gases. Elemental sulphur may be used as a precursor to other chemicals, such as sulphuric acid. Further, the disclosed method and system enable recovery of sulphur without losing sodium at the same time. The recovery of sulphur without sodium may be used to adjust the S/Na-balance of the pulp mill.

FIG. 1 illustrates, by way of an example, a system 100 for adjusting S/Na-balance of a sulphate pulp mill. The system 100 comprises a bioreactor 102 and a sulphur separation unit 106 located downstream of the bioreactor 102.

In a method implementable by the system 100, an aqueous pulp mill liquor 109 containing sulphides is collected. The pH of the aqueous pulp mill liquor 109 is alkaline. The pH of the aqueous pulp mill liquor 109 containing sulphides may be about 14. The aqueous pulp mill liquor 109 may comprise for example a pulp mill green liquor stream or a pulp mill white liquor stream.

The pulp mill green liquor stream may originate from a recovery boiler, in which the concentrated black liquor is combusted. The combustion forms a molten 'smelt' at the bottom of the recovery boiler. The smelt contains for example $Na_2CO_3$ and $Na_2S$. The smelt may be dissolved into a liquid, which may be for example water or weak white liquor. A liquid thus formed is denoted as green liquor due to a characteristic green color. The green liquor contains sulphides, such as $Na_2S$ and NaHS. The pulp mill green liquor stream may be clarified at a clarifier unit in order to provide the aqueous pulp mill liquor 109, or the pulp mill green liquor stream may be used as such in the method according to the invention. In the latter case, the pulp mill green liquor stream corresponds to the aqueous pulp mill liquor 109.

Figure 5:
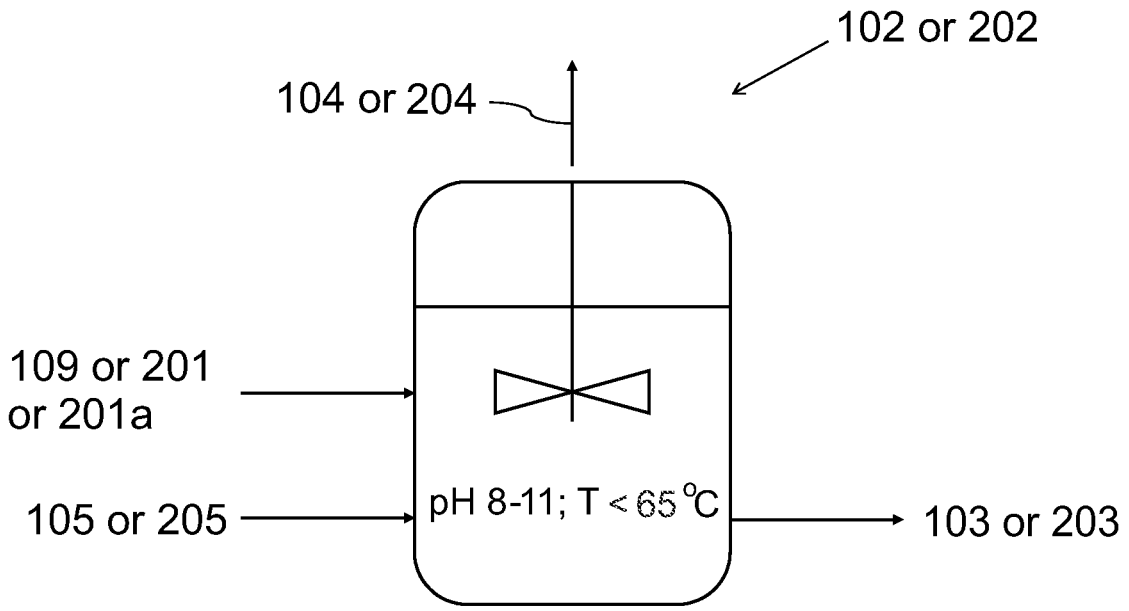
FIG. 5 illustrates, by way of an example, a bioreactor configured to separate sulphur from a pulp mill liquor stream.

The aqueous pulp mill liquor 109 is diverted into a bioreactor 102. FIG. 5 illustrates, by way of an example, the bioreactor 102, 202 with reference to FIGS. 1, 2*a* and 2*b*.

The temperature of the aqueous pulp mill liquor 109 is above room temperature prior to entering the bioreactor 102. Preferably, the temperature of the aqueous pulp mill liquor 109 is in the range of 40 to 60° C. prior to entering the bioreactor 102. When necessary, the temperature of the aqueous pulp mill liquor 109 may be lowered by a heat exchanger arranged upstream of the bioreactor 102. In the bioreactor 102 the aqueous pulp mill liquor 109 containing sulphides is oxidized biologically in an oxidizing reaction. The oxidizing takes place by means of sulphur-oxidizing microbes. In an exemplary pulp mill that produces one million air-dry tons of pulp per year, the volumetric flow rate of the aqueous pulp mill liquor 109 diverted into the bioreactor 102 may be 6.9 $m^3$ per hour. $Na_2S$ concentration of the aqueous pulp mill liquor 109 diverted into the bioreactor 102 may be 46.8 g/l.

The sulphur-oxidizing microbes may be autotrophic, heterotrophic or mixotrophic aerobic bacteria. The sulphur-oxidizing microbes may be alkaliphilic. The sulphur-oxidizing microbes may include for example the bacteria of the genera *Thiobacillus* and *Thiomicrospora*. The bacteria capable of oxidizing sulphide to elemental sulphur may be obtained for example from geothermal springs, oceanic geothermal vents, sulphidic cave systems, sulphide-rich industrial sites, sewage sludge, soil, salt marshes, soda lakes and cold springs. Alkaliphilic sulphur-oxidizing bacteria such as *Thioalkalimicrobium, Thioalkalivibrio* and *Thioalkalispira* may be isolated from soda lakes. They may be halophilic or halotolerant to varying degrees. The sulphur-oxidizing microbes may have at least one of the following properties: pH optimum above 9, usually below 10.5, in particular around 9.5; capability of oxidizing at least $H_2S/HS^-$; growth over a temperature range of 10-65° C.; tolerance for NaCl and sodium carbonates.

The bioreactor 102 may be aerated with a gas 105 comprising air and/or weak malodorous gas from the pulp mill. In the oxidizing reaction most of the sulphides of the aqueous pulp mill liquor 109 get oxidized into elemental sulphur. The efficiency of the oxidizing reaction may be equal to or more than 95%. As the chemical stability of the elemental sulphur produced decreases with increasing pH and temperature, the temperature inside the bioreactor should not exceed 65° C. The pH of a reaction medium inside the bioreactor 102 may be between 8-11. By aerating the bioreactor 102 with weak malodorous gas the pH of the reaction medium may be lowered. The bioreactor 102 may be a mixing reactor. The system 100 may contain more than one bioreactor. The bioreactors may be arranged in parallel.

The oxidizing reaction yields an aqueous suspension 103 containing elemental sulphur. The oxidizing reaction also yields a gas stream 104. The gas stream 104 may be forwarded from the bioreactor 102 to a processing of weak malodorous gases of the pulp mill. The processing of weak malodorous gases may be performed in the recovery boiler, in such a way that the weak malodorous gases are fed into the combustion air of the recovery boiler.

The aqueous suspension 103 containing elemental sulphur from the bioreactor 102 is conducted to a sulphur separation unit 106. In the sulphur separation unit 106 the elemental sulphur is separated from the aqueous suspension 103. A residual solution 108 and a precipitate 107 containing the elemental sulphur are thereby obtained. The sulphur separation unit 106 may be a conical separator. The separation may be performed for example by filtration, settling or flocculation. In an exemplary pulp mill that produces one million air-dry tons of pulp per year, the amount of elemental sulphur produced may be 128 kg per hour. From the sulphur separation unit 106, the residual solution 108, from which the precipitate 107 has been separated, may be directed to causticizing.

Figure 2A:
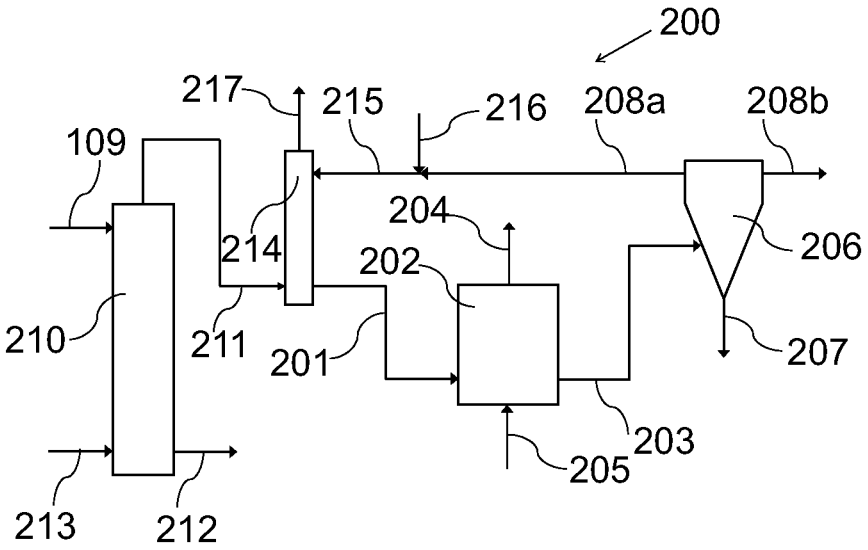
FIG. 2*a* illustrates, by way of an example, a variation of a process diagram of a system configured to adjust S/Na-balance of a pulp mill.
Figure 2B:
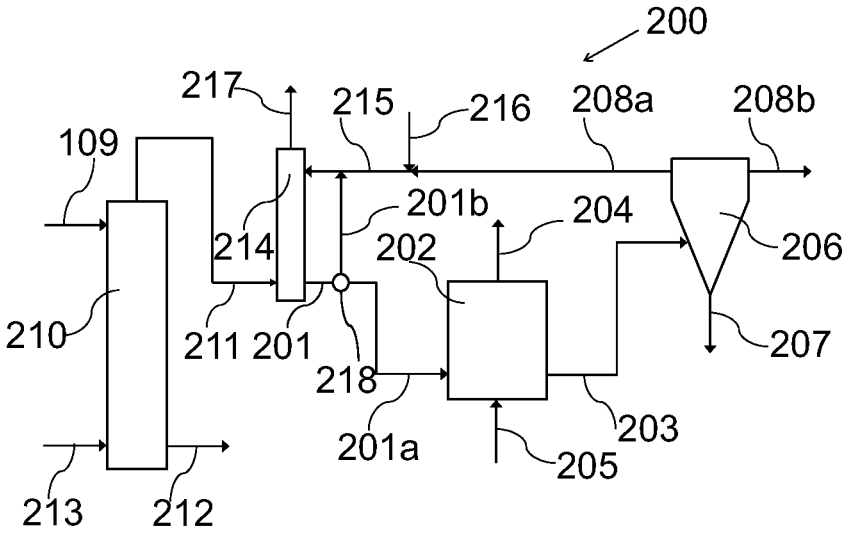
FIG. 2*b* illustrates, by way of an example, another variation of a process diagram of a system configured to adjust S/Na-balance of a pulp mill.

FIGS. 2*a* and 2*b* illustrate, by way of an example, a further system for separating sulphur from a pulp mill liquor stream. The system 200 comprises a stripper 210, a scrubber 214 located downstream of the stripper 210, a bioreactor 202 located downstream of the scrubber 214 and a sulphur separation unit 206 located downstream of the bioreactor 202.

In a method implementable by the system 200, an aqueous pulp mill liquor 109 containing sulphides is collected. The pH of the aqueous pulp mill liquor 109 is alkaline. The pH of the aqueous pulp mill liquor 109 containing sulphides may be about 14. The aqueous pulp mill liquor 109 may comprise for example a pulp mill green liquor stream or a pulp mill white liquor stream. The aqueous pulp mill liquor 109 is diverted into the stripper 210. In an exemplary pulp mill that produces one million air-dry tons of pulp per year, a volumetric flow rate of the aqueous pulp mill liquor 109 diverted into the stripper 210 may be 54.2 $m^3$ per hour. $Na_2S$ concentration of the aqueous pulp mill liquor 109 diverted into the stripper 210 may be 46.8 g/l.

The aqueous pulp mill liquor 109 containing sulphides is stripped in the stripper 210 with an acidic agent. The acidic agent may be for example carbon dioxide ($CO_2$) or an acidic solution. Into the stripper 210, a stripping fluid stream 213 comprising the acidic agent is fed. The stripping fluid stream 213 may comprise for example pure carbon dioxide or flue gas. In the stripper 210, the stripping fluid stream 213 lowers the pH of the aqueous pulp mill liquor 109, thereby causing formation of $H_2S$ from the sulphides of the aqueous pulp mill liquor 109. A pH of the aqueous pulp mill liquor 109 while stripping may be 7 or less.

Figure 3:
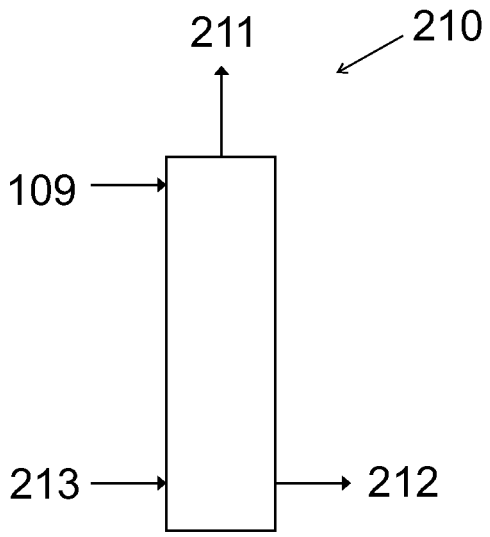
FIG. 3 illustrates, by way of an example, a stripper configured to separate sulphur from a pulp mill liquor stream.

As illustrated by FIG. 3, the stripping in the stripper 210 is performed in a counter current manner. The aqueous pulp mill liquor 109 containing sulphides is fed into the stripper 210 at the upper part of the stripper 210 and is arranged to flow downwards towards the lower part of the stripper 210. The stripping fluid stream 213 is fed into the stripper 210 at the lower part of the stripper 210 and is arranged to flow upwards towards the upper part of the stripper 210. The stripper 210 may be a plate column or a packed bed column.

The stripping yields a gas stream 211 containing $H_2S$ and a residual pulp mill liquor stream 212. The $H_2S$ concentration of the gas stream 211 may be 99 vol-%. The residual pulp mill liquor stream 212 may be fed back to the chemical recovery cycle of the pulp mill. In an exemplary pulp mill that produces one million air-dry tons of pulp per year, the mass flow rate of the gas stream 211 containing $H_2S$ may be 553 kg per hour. The volumetric flow rate of the residual pulp mill liquor stream 212 may be 54.2 $m^3$ per hour. $Na_2S$ concentration of the residual pulp mill liquor stream 212 may be 23.4 g/l.

Figure 4:
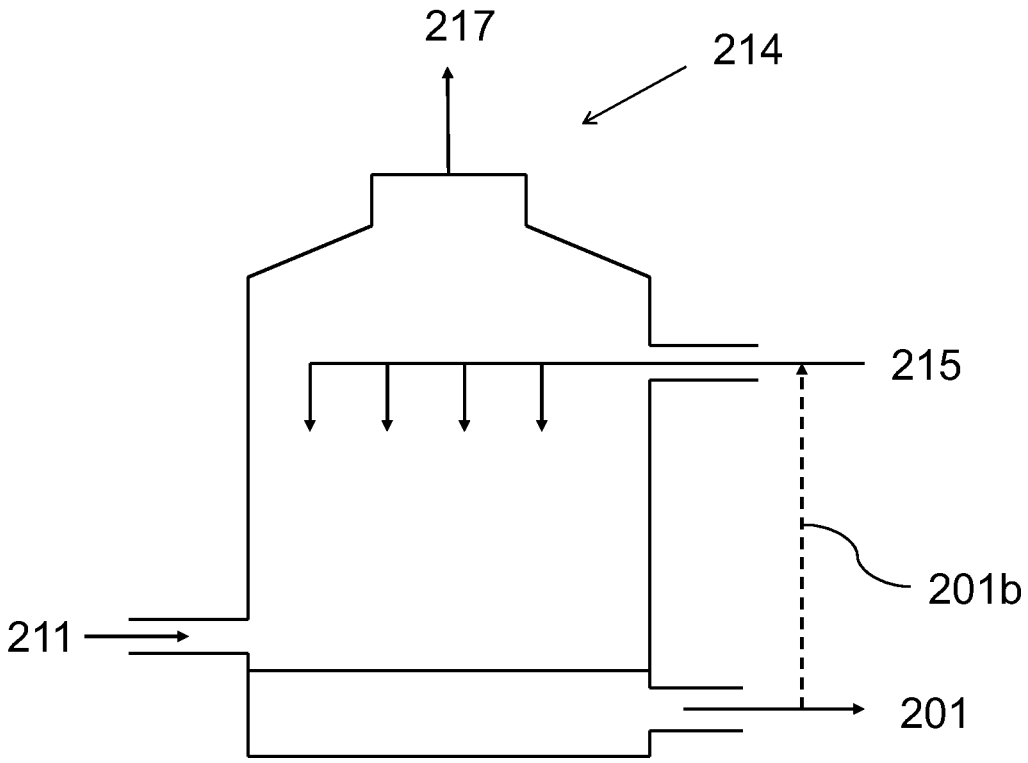
FIG. 4 illustrates, by way of an example, a scrubber configured to separate sulphur from a pulp mill liquor stream.

FIG. 4 illustrates, by way of an example, the scrubber 214 with reference to FIGS. 2*a* and 2*b*. The gas stream 211 containing $H_2S$ is fed into the scrubber 214. In the scrubber 214 the gas stream 211 containing $H_2S$ is scrubbed with an aqueous scrubbing solution 215. The pH of the aqueous scrubbing solution 215 may be adjusted with an alkaline agent. A stream 216 comprising the alkaline agent may be configured to feed the alkaline agent to the aqueous scrubbing solution 215. The alkaline agent may be for example NaOH solution or oxidized white liquor. The pH of the aqueous scrubbing solution 215 may be above 8. Preferably, the pH of the aqueous scrubbing solution 215 is above 11.5. The pH of the aqueous scrubbing solution 215 may be in the range of 12 to 14. The efficiency of scrubbing improves with higher pH. When NaOH is utilized as the alkaline agent, the mass flow rate of NaOH fed into the aqueous scrubbing solution 215 may be 25 kg per hour in an exemplary pulp mill that produces one million air-dry tons of pulp per year.

In the scrubber 214, intensive contact between the gas stream 211 containing $H_2S$ and the aqueous scrubbing solution 215 is enabled. At least some of the $H_2S$ of the gas stream 211 reacts with the alkaline agent of the aqueous scrubbing solution 215, thereby forming sulphides, such as $Na_2S$ and NaHS. A residual gas stream 217 and an aqueous spent scrubbing solution 201 containing sulphides are produced in the scrubber 214. $Na_2S$/NaHS mixture ratio of the aqueous spent scrubbing solution 201 is dependent on the pH of the aqueous spent scrubbing solution 201. The residual gas stream 217 may be forwarded from the scrubber 214 to a processing of strong malodorous gases of the pulp mill. The processing of strong malodorous gases may comprise burning of the gases for example in a recovery boiler.

The scrubber 214 may be an absorption tower of a packed bed column type. The scrubber 214 provides a straight contact area between a gas and a liquid. Advantageously, the system 100, 200 may comprise at least one conduit configured to direct residual gas stream 217 from the scrubber 214 into the pulp mill recovery boiler. This enables that at least some of the residual gas stream 217 from the scrubber 214 may be directed into the pulp mill recovery boiler, thereby enabling recirculation of chemicals from the residual gas stream 217 into the chemical recovery cycle of the pulp mill. Thus the method and the system which enables adjustment of S/Na-balance of a pulp mill by separation of sulphur compounds from pulp mill liquors, which comprise sulphides, and oxidation of sulphides into elemental sulphur with microbes, may be further enhanced by introducing chemicals from the gas stream 211 containing $H_2S$ back into the chemical recovery cycle of the pulp mill.

The aqueous spent scrubbing solution 201, 201*a* containing sulphides is conducted into the bioreactor 202 (FIG. 5). The temperature of the aqueous spent scrubbing solution 201, 201*a* prior to entering the bioreactor 202 is above room temperature. Preferably, the temperature of the aqueous spent scrubbing solution 201, 201*a* is in the range of 40 to 60° C. prior to entering the bioreactor 202. In the bioreactor 202 the aqueous spent scrubbing solution 201, 201*a* containing sulphides is oxidized biologically in an oxidizing reaction. The oxidizing takes place by means of sulphur-oxidizing microbes.

According to an embodiment illustrated in FIG. 2*b*, at least some of the aqueous spent scrubbing solution 201*b* is recirculated by a pump 218 back to the scrubber 214. Thus, the aqueous spent scrubbing solution 201 is divided into two portions 201*a* and 201*b*. By this arrangement, the sulphur compounds of the gas stream 211 may be more efficiently converted into sulphides.

The bioreactor 202 may be aerated with a gas 205 comprising air and/or weak malodorous gas from the pulp mill. In the oxidizing reaction most of the sulphides of the aqueous spent scrubbing solution 201, 201*a* get oxidized into elemental sulphur. The efficiency of the oxidizing reaction may be equal to or more than 95%. As the chemical stability of the elemental sulphur produced decreases with increasing pH and temperature, the temperature inside the bioreactor should not exceed 65° C. The pH of the reaction medium inside the bioreactor 202 may be between 8-11. By aerating the bioreactor 202 with weak malodorous gas the pH of the reaction medium may be lowered. By this way, use of somewhat higher pH than what is optimal for the bioreactor 202, in the scrubber 214, may be compensated by aerating the bioreactor 202 with weak malodorous gas capable of lowering the pH of the reaction medium. The bioreactor 202 may be a mixing reactor. The system 200 may contain more than one bioreactor. The bioreactors may be arranged in parallel.

The oxidizing reaction yields an aqueous suspension 203 containing elemental sulphur. The oxidizing reaction also yields a gas stream 204. The gas stream 204 may be forwarded from the bioreactor 202 to a processing of weak malodorous gases of the pulp mill. The processing of weak malodorous gases may be performed in the recovery boiler, in such a way that the weak malodorous gases are fed into the combustion air of the recovery boiler. Advantageously, the system 100, 200 may comprise at least one conduit configured to direct gas stream 104, 204 from the bioreactor 105, 205 into the pulp mill recovery boiler. This enables that at least some of the gas stream 104, 204 from the bioreactor 105, 205 may be directed into the pulp mill recovery boiler, thereby enabling recirculation of chemicals from the gas stream 104, 204 into the chemical recovery cycle of the pulp mill. Thus the method and the system which enables adjustment of S/Na-balance of a pulp mill by separation of sulphur compounds from pulp mill liquors, which comprise sulphides, and oxidation of sulphides into elemental sulphur with microbes, may be further enhanced by introducing chemicals from the gas stream 104, 204 back into the chemical recovery cycle of the pulp mill.

The aqueous suspension 203 containing elemental sulphur from the bioreactor is conducted to a sulphur separation unit 206. In the sulphur separation unit 206 elemental sulphur is separated from the aqueous suspension 203. A residual solution 208*a*, 208*b* and a precipitate 207 containing the elemental sulphur are thus obtained. The sulphur separation unit 206 may be a conical separator. The separation may be performed for example by filtration, settling or flocculation. In an exemplary pulp mill that produces one million air-dry tons of pulp per year, the amount of elemental sulphur produced may be 500 kg per hour. The mass flow rate of the residual solution 208*a*, 208*b* with respect to sulphur may be 10 kg per hour.

The embodiment illustrated in FIG. 2*b*, in which at least some of the aqueous spent scrubbing solution 201*b* is recirculated by a pump 218 back to the scrubber 214, enables use of a smaller sulphur separation unit 206 compared to the system disclosed in FIG. 2*a*. As the sulphur compounds of the gas stream 211 are more efficiently converted into sulphides, the volume of the aqueous suspension 203 containing elemental sulphur may be smaller, and thus a smaller unit is needed for separation of the residual solution 208 and the precipitate 207 containing the elemental sulphur.

From the sulphur separation unit 206, at least some of the residual solution 208*a*, from which the precipitate 207 has been separated, may be directed back into the scrubber 214 to replenish the aqueous scrubbing solution 215. Thus, the possible un-oxidized sulphur compounds of the residual solution 208*a* may be directed back to the bioreactor 202 for oxidizing. Further, recirculating the liquid diminishes the need for fresh water and reduces the unnecessary use of the valuable natural resources. The residual solution 208*b* may be fed back to the chemical recovery cycle of the pulp mill.

Many variations of the method and system will suggest themselves to those skilled in the art in light of the description above. Such obvious variations are within the full intended scope of the appended claims.

The invention claimed is:

1. A method for adjusting S/Na-balance of a pulp mill, the method comprising:

providing a sulphate pulp mill producing a gas comprising weak malodorous gas, the sulphate pulp mill comprising a recovery boiler producing an aqueous pulp mill liquor containing sulphides, diverting the aqueous pulp mill liquor containing sulphides from the recovery boiler into a bioreactor, oxidizing the aqueous pulp mill liquor containing sulphides in the bioreactor biologically in an oxidizing reaction by means of sulphur-oxidizing microbes, thereby producing an aqueous suspension containing elemental sulphur, separating the elemental sulphur from the aqueous suspension in a sulphur separation unit located downstream of the bioreactor, thereby obtaining a residual solution and a precipitate containing the elemental sulphur, and aerating the bioreactor with the gas comprising the weak malodorous gas, the weak malodorous gas being directed via at least one conduit connected to the pulp mill, from the pulp mill to the bioreactor.

2. The method according to claim 1, wherein the aqueous pulp mill liquor is green liquor or white liquor.

3. The method according to claim 1, further comprising clarifying pulp mill liquor stream at a clarifier unit, thereby providing the aqueous pulp mill liquor.

4. The method according to claim 1, wherein the aqueous pulp mill liquor has a temperature in above room temperature prior to entering the bioreactor.

5. The method according to claim 1, further comprising the step of directing at least some of a gas stream from the bioreactor into the recovery boiler, thereby enabling recirculation of chemicals from the gas stream into a chemical recovery cycle of the pulp mill.

6. A method for adjusting S/Na -balance of a pulp mill, the method comprising:

providing a sulphate pulp mill producing a gas comprising weak malodorous gas, the sulphate pulp mill comprising a recovery boiler producing an aqueous pulp mill liquor containing sulphides, diverting the aqueous pulp mill liquor containing sulphides from the recovery boiler into a stripper, stripping the aqueous pulp mill liquor containing sulphides in the stripper with an acidic agent, thereby obtaining a gas stream containing $H_2S$ and a residual pulp mill liquor stream, scrubbing the gas stream containing $H_2S$ in a scrubber located downstream of the stripper with an aqueous scrubbing solution containing an alkaline agent, whereby at least some of the $H_2S$ reacts with the alkaline agent, thereby producing a residual gas stream and an aqueous spent scrubbing solution containing sulphides, oxidizing the aqueous spent scrubbing solution containing sulphides in a bioreactor biologically in an oxidizing reaction by means of sulphur-oxidizing microbes, thereby producing an aqueous suspension containing elemental sulphur, separating the elemental sulphur from the aqueous suspension in a sulphur separation unit located downstream of the bioreactor, thereby obtaining a residual solution and a precipitate containing the elemental sulphur, and aerating the bioreactor with the gas comprising the weak malodorous gas, the weak malodorous gas being directed via at least one conduit connected to the pulp mill, from the pulp mill to the bioreactor.

7. The method according to claim 6, further comprising the step of directing at least some of the residual solution, from which the precipitate has been separated, back into the scrubber to replenish the aqueous scrubbing solution.

8. The method according to claim 6, further comprising the step of directing at least some of the aqueous spent scrubbing solution by a pump back into the scrubber for re-scrubbing.

9. The method according to claim 6, further comprising the step of clarifying pulp mill liquor stream at a clarifier unit, thereby providing the aqueous pulp mill liquor.

10. The method according to claim 6, wherein either the aqueous pulp mill liquor or the aqueous spent scrubbing solution has a temperature above room temperature prior to entering the bioreactor.

11. The method according to claim 6, further comprising the step of adjusting the pH of the aqueous scrubbing solution with the alkaline agent, such that the pH of the aqueous scrubbing solution is above 8.

12. The method according to claim 6, further comprising the step of directing at least some of the residual gas stream from the scrubber into the recovery boiler, thereby enabling recirculation of chemicals from the residual gas stream into a chemical recovery cycle of the pulp mill.

13. The method according to claim 6, further comprising the step of directing at least some of a gas stream from the bioreactor into the recovery boiler, thereby enabling recirculation of chemicals from the gas stream into a chemical recovery cycle of the pulp mill.

14. The method according to claim 6, wherein the aqueous pulp mill liquor is green liquor or white liquor.

15. A system configured to adjust S/Na-balance of a pulp mill, the system comprising:

one or more conduits connected to a sulphate pulp mill producing a gas comprising weak malodorous gas, the sulphate pulp mill comprising a recovery boiler producing an aqueous pulp mill liquor containing sulphides, the one or more conduits feeding the aqueous pulp mill liquor containing sulphides from the recovery boiler of the sulphate pulp mill into a bioreactor, the bioreactor configured to oxidize the aqueous pulp mill liquor with sulphur-oxidizing microbes, the bioreactor thereby configured to produce an aqueous suspension containing elemental sulphur, a sulphur separation unit located downstream of the bioreactor, the sulphur separation unit configured to produce a residual solution and a precipitate containing the elemental sulphur, and at least one conduit connected to the sulphate pulp mill to direct the gas comprising the weak malodorous gas from the pulp mill to the bioreactor, the at least one conduit being configured to aerate the bioreactor with the gas comprising the weak malodorous gas.

16. The system according to claim 15, further comprising at least one further conduit connected to the pulp mill recovery boiler to direct gas stream from the bioreactor into the pulp mill recovery boiler, thereby enabling recirculation of chemicals from the gas stream into the chemical recovery cycle of the pulp mill.

17. The system according to claim 15, the system comprising more than one bioreactor.

18. The system according to claim 15, wherein the aqueous pulp mill liquor is green liquor or white liquor.

19. A system arranged to adjust the S/Na-balance of a pulp mill, the system comprising:

one or more conduits connected to a sulphate pulp mill producing a gas comprising weak malodorous gas, the sulphate pulp mill comprising a recovery boiler producing an aqueous pulp mill liquor containing sulphides, the one or more conduits feeding the aqueous pulp mill liquor containing sulphides into a stripper, the stripper being configured to strip the aqueous pulp mill liquor with an acidic agent, thereby producing a gas stream containing $H_2S$ and a residual pulp mill liquor stream, a scrubber located downstream of the stripper, the scrubber being configured to scrub the gas stream containing $H_2S$ with an aqueous scrubbing solution containing an alkaline agent, thereby producing a residual gas stream and an aqueous spent scrubbing solution containing sulphides, one or more conduits configured to conduct the aqueous spent scrubbing solution containing sulphides into a bioreactor, the bioreactor being located downstream of the scrubber, the bioreactor being configured to oxidize the aqueous spent scrubbing solution containing sulphides with sulphur-oxidizing microbes, the bioreactor thereby being configured to produce an aqueous suspension containing elemental sulphur, a sulphur separation unit located downstream of the bioreactor, the sulphur separation unit being configured to produce a residual solution and a precipitate containing the elemental sulphur, and at least one conduit connected to the sulphate pulp mill to direct the gas comprising the weak malodorous gas from the pulp mill to the bioreactor, the at least one conduit being configured to aerate the bioreactor with the gas comprising the weak malodorous gas.

20. The system according to claim 19, further comprising a pump and a conduit configured to direct at least some of the aqueous spent scrubbing solution back into the scrubber for re-scrubbing.

21. The system according to claim 19, further comprising at least one conduit connected to a recovery boiler of the sulphate pulp mill to direct residual gas stream from the scrubber into the recovery boiler, thereby enabling recirculation of chemicals from the gas stream containing $H_2S$ into a chemical recovery cycle of the pulp mill.

22. The system according to claim 19, further comprising at least one conduit connected to a recovery boiler of the sulphate pulp mill to direct gas stream from the bioreactor into the recovery boiler, thereby enabling recirculation of chemicals from the gas stream into a chemical recovery cycle of the pulp mill.

23. The system according to claim 19, the system comprising more than one bioreactor.

24. The system according to claim 19, wherein the aqueous pulp mill liquor is green liquor or white liquor.

* * * * *